US008637772B2

(12) United States Patent
Anderton

(10) Patent No.: US 8,637,772 B2
(45) Date of Patent: Jan. 28, 2014

(54) ELECTRIC CORD SECURING DEVICE AND METHODS OF USE THEREOF

(76) Inventor: Bryan Anderton, Austin, TX (US)

( * ) Notice: Subject to any disclaimer, the term of this patent is extended or adjusted under 35 U.S.C. 154(b) by 168 days.

(21) Appl. No.: 12/849,575

(22) Filed: Aug. 3, 2010

(65) Prior Publication Data

US 2012/0030910 A1 Feb. 9, 2012

(51) Int. Cl.
*H01B 7/00* (2006.01)

(52) U.S. Cl.
USPC ..... 174/135; 174/40 CC; 439/501; 411/15

(58) Field of Classification Search
USPC ..... 411/15; 439/501; 24/16 R; 403/397; 16/86 A; 174/40 CC, 135
See application file for complete search history.

(56) References Cited

U.S. PATENT DOCUMENTS 3,654,669 A 4/1972 Fulton
4,768,974 A * 9/1988 Cowan et al. ..... 439/371
5,167,524 A * 12/1992 Falcon et al. ..... 439/371
5,502,877 A 4/1996 Yocum
5,581,850 A 12/1996 Acker
5,745,958 A 5/1998 Kaldor
6,332,248 B1 12/2001 Daniggelis et al.
6,523,229 B2 * 2/2003 Severson ..... 24/16 PB
6,640,393 B2 11/2003 Wendle
7,172,456 B1 * 2/2007 Nagy ..... 439/501

* cited by examiner

*Primary Examiner* — Dhirubhai R Patel
(74) *Attorney, Agent, or Firm* — Meyertons, Hood, Kivlin, Kowert & Goetzel, P.C.; Eric B. Meyertons

(57) ABSTRACT

An electric cord securing device includes an attaching member and a securing member coupled to a body. The attaching member, during use, attaches the body to a selected location on the exterior of a electric cord. The securing member, during use, secures the body to an external structure or at least one other portion of the electric cord. Additionally, an electric cord includes at least one flexible conductor encased by a insulating sheath. One or more securing members are disposed on the exterior of the sheath. The securing members secure the portion of the cord proximate the securing member to at least one other portion of the electric cord or an external structure.

20 Claims, 8 Drawing Sheets

ELECTRIC CORD SECURING DEVICE AND METHODS OF USE THEREOF

BACKGROUND OF THE INVENTION

1. Field of the Invention

The present invention generally relates to cord securing devices. In particular, embodiments relate to electric cord securing devices that are couplable to an electric cord.

2. Description of the Relevant Art

When stowed or transported, lengthy electric cords are usually coiled into bundles or hanks. It is then often desired to maintain the coiled arrangement to keep the electric cords organized and untangled. Accordingly, cable ties are commonly used to securely fasten, or bind, the coiled bundles.

Several cable tie devices have been developed to bind coiled electric cords. Unfortunately, permanently fastened cable ties must be discarded after a single use and releasable cable ties are easily lost, misplaced, or irreparably damaged from repeated use. Furthermore, it seems that many releasable cable ties are not easily engaged and/or disengaged with the electric cord and thus, are difficult to use.

In view of these and other concerns, a device for securing an electric cord that is fixably attachable to the cord, durable, reusable, and easy to use may be desired.

SUMMARY

Described herein are various embodiments of an electric cord securing device and methods of use thereof. In some embodiments, a device for securing an electric cord includes an attaching member and a securing member coupled to a body. In various embodiments, during use, the attaching member selectively attaches the body to an electric cord at a selected location on the exterior of the cord, such that the body is fixably attached to the cord at the selected location. In various embodiments, during use, the securing member selectively secures the body to an external structure or at least one other portion of the electric cord. In certain embodiments, the securing member includes a pliable wire.

In some embodiments, an electric cord includes at least one flexible conductor encased by an insulating sheath. In various embodiments, the sheath includes at least one securing member. In certain embodiments, during use, the securing member selectively secures the portion of the cord proximate the securing member to at least one other portion of the cord or an external structure. In an embodiment, the securing member is positioned such that the distal end of the member cannot contact the ends of the cord.

In some embodiments, a method of securing an electric cord includes coupling at least a portion of an electric cord securing device to an electric cord. In various embodiments, coupling at least a portion of the electric cord securing device to an electric cord includes attaching the body of the electric cord securing device to the electric cord at a selected location on the exterior of the cord via an attaching member coupled to the body, such that the body is fixably attached to the cord at the selected location. In some embodiments, the method further includes securing the body to an external structure or at least one other portion of the electric cord via a securing member coupled to the body.

BRIEF DESCRIPTION OF THE DRAWINGS

Advantages of the present invention will become apparent to those skilled in the art with the benefit of the following detailed description of embodiments and upon reference to the accompanying drawings in which.

Figure 1A:
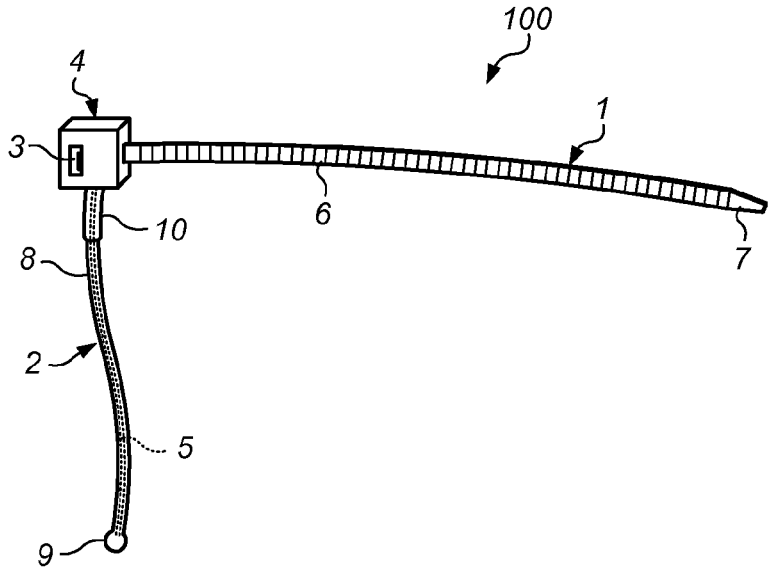
FIG. 1*a* is a perspective view of an embodiment of an electric cord securing device including a pliable wire.
Figure 1B:
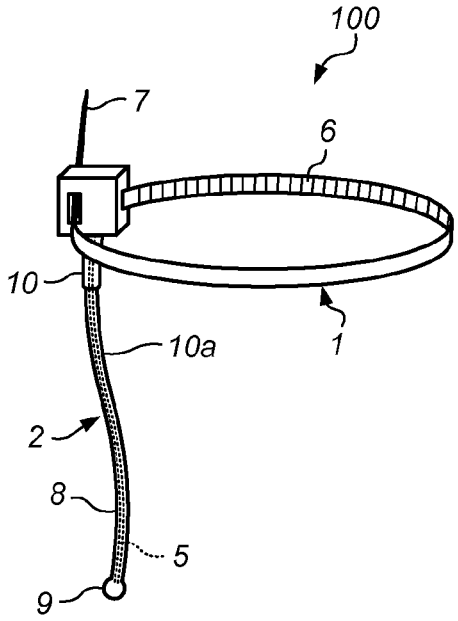
FIG. 1*b* is a perspective view of the embodiment of the electric cord securing device in FIG. 1*a* depicting the formation of a cinching loop.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

In the context of this application, the following terms are defined as:

"Coupled" means either a direct connection or an indirect connection (e.g., one or more intervening connections) between one or more objects or components. The phrase "directly connected" means a direct connection between objects or components such that the objects or components are connected directly to each other so that the objects or components operate in a "point of use" manner.

A "member" refers to a constituent part of a system, device, or assembly. A member may include a strap, wire, cord, rope, plate, link, or other objects of various sizes, shapes, forms, and properties. A member may be a single component or a combination of components coupled to one another.

A "body" refers to any physical structure capable of at least partially supporting another element. A body may have various regular or irregular shapes. For example, portions of a body may be straight, curved, or a combination of both.

An "attaching member" refers to a member coupled to a body and configured to fixably attach the body to at least a portion of an electric cord.

A "securing member" refers to a member coupled to a body and configured to secure the body to at least a portion of an object and/or a portion of an electric cord.

An "electric cord" refers to any wire, cable, cord, or other elongated object capable of connecting an electrical appliance to one or more other electrical appliances or a power source.

A "wire" refers to a stringlike piece of relatively rigid or flexible material. A wire may be of any suitable thickness, length, and cross-section. A wire may be a single wire or two or more wires bound to each other.

An "external structure" refers to any mass that is not a constituent or part of the system, device, or assembly.

A "coating material" refers to any material composition capable of covering a surface.

A "housing" refers to any opening, aperture, or receptacle that can receive or accommodate another element.

A "pawl" refers to a member adapted to engage with one or more teeth so as to prevent or to inhibit motion.

A "sheath" refers to any close fitting covering or case.

A "handle" refers to a part of an object made specifically to be grasped or held by a human hand.

FIGS. 1*a*-1*d* provide various illustrations of an embodiment of a device for securing an electric cord. Electric cord securing device 100 includes attaching member 1 and securing member 2 coupled to body 4. Attaching member 1 extends substantially perpendicularly from body 4 with respect to securing member 2. Attaching member 1 includes locking teeth 6 vertically positioned thereon. Attaching and securing members may include any number of locking teeth spaced at any predetermined intervals. Attaching member 1 further includes tapered end 7. In some embodiments, the attaching and securing members are flexible and/or bendable. In certain embodiments, the attaching and securing members are sufficiently flexible and/or bendable to wrap around the exterior of an electrical cord. Furthermore, attaching and securing members may be composed of any suitable material possessing any suitable mechanical properties. Securing member 2 includes pliable wire 5. The pliable wire may be of suitable length, diameter, and mechanical stiffness to be twisted or wrapped around at least a portion of an electric cord or an external structure. In some embodiments, the pliable wire is provided with a sufficient mechanical stiffness to bind an electrical cord in a coil when wrapped or twisted circumferentially at least once around a section of the coil (see FIG. 8*b*). According to the depicted embodiment, pliable wire 5 is encased by coating material 8. In certain embodiments, the coating material is an electrical insulator. In one embodiment, the coating material is a polymeric coating. A polymeric coating may be formed from any synthetic or natural polymeric material. Examples of suitable polymeric coating materials include, but are not limited to: polypropylene, polystyrene, polyethylene terephthalate, polyamides, polyvinyl chloride, polyurethanes, polyvinylidene chloride, polyethylene, polytetrafluoroethylene, polyetherimide, and polymethyl methacrylate.

Figure 1C:
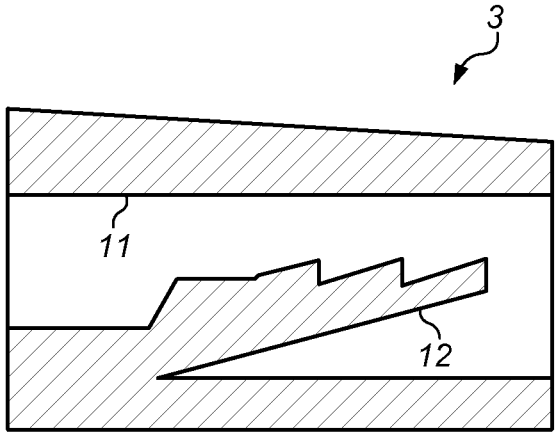
FIG. 1*c* is a cross-sectional view of the housing of the electric cord securing device shown in FIG. 1*a;*
Figure 1D:
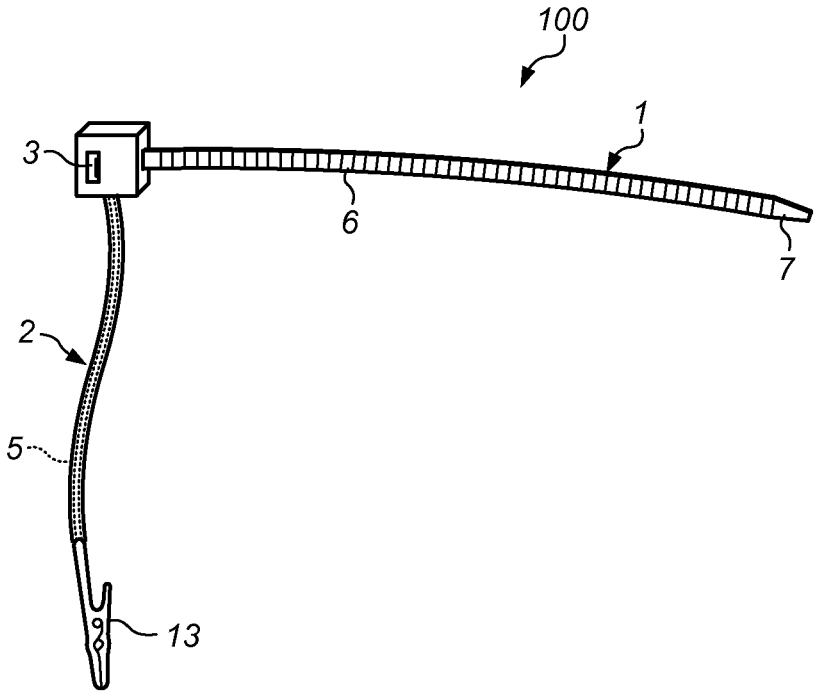
FIG. 1*d* is a perspective view of the embodiment of an electrical securing device in FIG. 1*a* depicting a clamp mounted on the distal end of the securing member.

Pliable wire includes neck 10. In some embodiments, the neck is provided with a higher mechanical stiffness than other portions 10*a* of the pliable wire. Providing the neck of the pliable wire with a higher mechanical stiffness than other portions of the wire may advantageously prohibit the distal end of the wire from being twisted or folded back into an electrical socket or plug when the electric cord is plugged in. Pliable wire 5 also includes handle 9 formed on the distal end of the wire. Handle 9 may facilitate manipulation of the pliable wire. A pliable wire may also include one or more utility components (e.g., a hook, damp, hanging loop, and etc.) coupled to the distal end. For example, as depicted in FIG. 1*d*, pliable wire 5 includes clamp 13 (e.g., a spring based clamp) coupled to the distal end of the wire. Any known utility component may be coupled to the pliable wire.

According to the depicted embodiment, body 4 includes integrally formed housing 3. In some embodiments, the housing is chemically or mechanically joined to the body. In various embodiments, the housing, during use, receives the attaching member, such that when the attaching member is fed through the housing from the distal end, a cinching loop is formed (see FIG. 1*b*). In some embodiments, during use, the body is fixably attached to a portion of an electrical cord via the cinching loop. As depicted in FIG. 1*c*, housing 3 includes strap passage 11 with pawl 12 mounted and extending therethrough. In some embodiments, the pawl is configured so that it is urged and momentarily displaced by the locking teeth of the attaching member when the member is pulled forward through the strap passage. Conversely, when the attaching member is pulled rearwardly, the pawl engages the locking teeth of the attaching member, thereby inhibiting withdrawal of the attaching member. In certain embodiments, the housing is configured to facilitate tightening and loosening of the cinching loop. For example, the housing may include a mechanical release to prohibit the pawl from engaging with the locking teeth of the attaching member, thereby allowing the attaching member to be withdrawn from the housing.

Figure 2A:
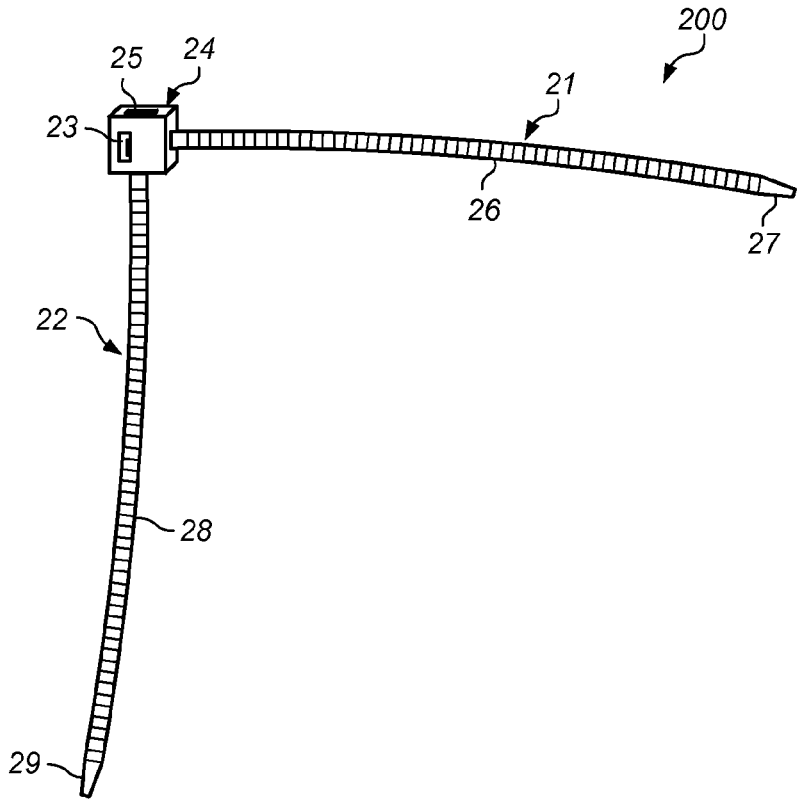
FIG. 2*a* is a perspective view of an additional embodiment of an electric cord securing device.

FIG. 2*a* illustrates an additional embodiment of an electric cord securing device. Electric cord securing device 200 includes attaching member 21 and securing member 22 coupled to body 24. Attaching member 21 extends substantially perpendicularly from body 24 with respect to securing member 22. Attaching member 21 includes locking teeth 26 vertically positioned thereon. Attaching member 21 further includes tapered end 27. Similarly, securing member 22 includes locking teeth 28 vertically positioned thereon and tapered end 29.

When an electric cord is coiled into a bundle or hank, the diametrical thickness of any section of the coil is greater than that of the electric cord. As such, in some embodiments, the length of the securing member is greater than the length of the attaching member. Providing the lengths as such may advantageously reduce the materials used to produce the device and subsequently reduce costs.

Figure 2B:
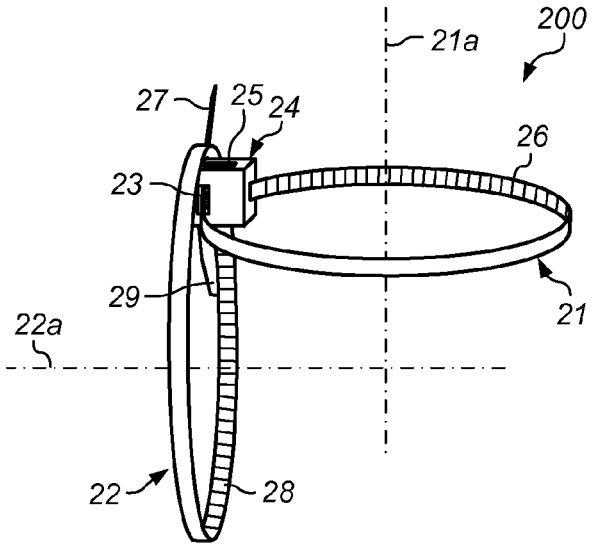
FIG. 2*b* is a perspective view of the embodiment of an electric cord securing device in FIG. 2*a* depicting the formation of two cinching loops.

According to the current embodiment, as shown in FIG. 2*b*, body 24 includes integrally formed housings 23 and 25. In some embodiments, housings 23 and 25, during use, receive attaching and securing members 21 and 22 respectively, such that cinching loops are formed (see FIG. 2*b*). Further, housings 23 and 25 are positioned in conjunction with attaching and securing members 21 and 22 such the cinching loops formed are centered about substantially perpendicular axes 21*a* and 22*a*.

Figure 3A:
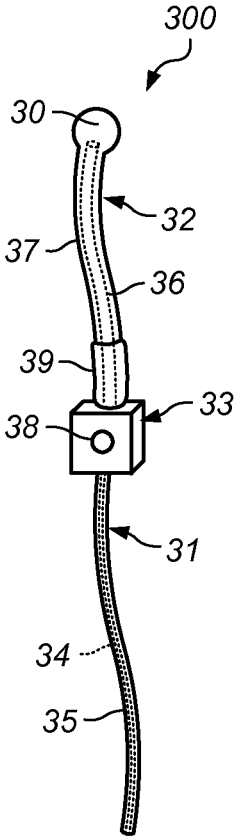
FIG. 3*a* is a perspective view of an embodiment of an electric cord securing device including two pliable wires.

FIG. 3*a* illustrates another embodiment of an electric cord securing device. Electric cord securing device 300 includes attaching member 31 and securing member 32 integrally formed with body 33. Attaching member 31 extends in a direction that is substantially opposite to securing member 32. Attaching member 31 includes pliable wire 34 encased by coating material 35. Similarly, securing member 32 includes pliable wire 36 encased by coating material 37. Pliable wire 36 also includes neck 39. The pliable wire of the attaching member may be of suitable length, diameter, and mechanical stiffness to be twisted or wrapped tightly around the exterior of an electric cord. Securing member 32 further includes handle 30 formed on the distal end of the wire. In some embodiments, the pliable wire of the attaching member is of greater pliability and/or lesser diameter than the pliable wire of the securing member. This may be advantageous, for example, when securing small diameter electric cords.

Figure 3B:
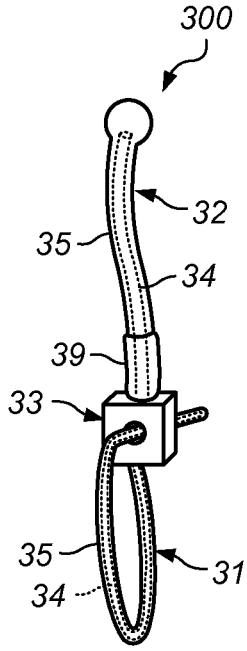
FIG. 3*b* is a perspective view of the embodiment of an electric cord securing device in FIG. 3*a* depicting the formation of a cinching loop.

According to the current embodiment, body 33 includes integrally formed housing 38. In some embodiments, housing 38, during use, receives attaching member 31, such that a cinching loop is formed, as depicted in FIG. 3*b*. For example, the housing may be provided with an adequate diameter to impart considerable resistive forces (i.e., friction, pressure, etc.) on the attaching member so as to allow the attaching member to be pulled through the housing (both forward and backward) with sufficient force while inhibiting inadvertent loosening of the cinching loop. In some embodiments, the thickness of the attaching member increases or decreases along the length of the member (either gradually or stepwise). That is, in certain embodiments, the proximal end of the attaching member may have a greater thickness than the distal end in order to impart a greater or lesser resistive force when it is pulled through the housing (either forward or backward).

Figure 4:
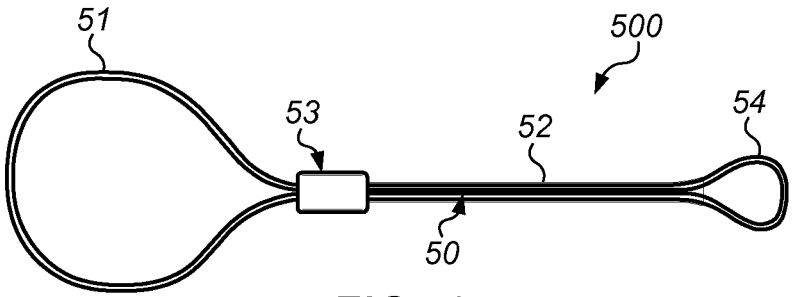
FIG. 4 is a side view of an additional embodiment of an electric cord securing device.

FIG. 4 illustrates yet another embodiment of an electric cord securing device. Electric cord securing device 500 includes attaching member 51 and securing member 52. Attaching member 51 and securing member 52 are formed from a single pliable wire 50. Electric cord securing device 500 further includes body 53. Body 53 includes a housing (not shown) receiving a portion of pliable wire 50. Attaching member 51 in conjunction with body 53 may form a cinching loop. For example, attaching member 51 may be pulled through the housing of body 53 (either forward or backward) in order to tighten or loosen the cinching loop. As stated above, the housing may be provided with an adequate diameter to impart considerable resistive forces (i.e., friction, pressure, etc.) on the attaching member so as to allow the attaching member to be pulled through the housing with sufficient force while inhibiting inadvertent loosening of the cinching loop. In some embodiments, securing member 52 is of a sufficient thickness, and/or has appropriate surface roughening/texturing, to inhibit or prevent pulling the securing member back out of the housing.

Electric cord securing device may still further include loop 54. Loop 54 may facilitate stowing of a secured electric cord. For example, loop 54 may receive a wall mounted hook during use such that the secured electric cord is hung from the hook.

Figure 5:
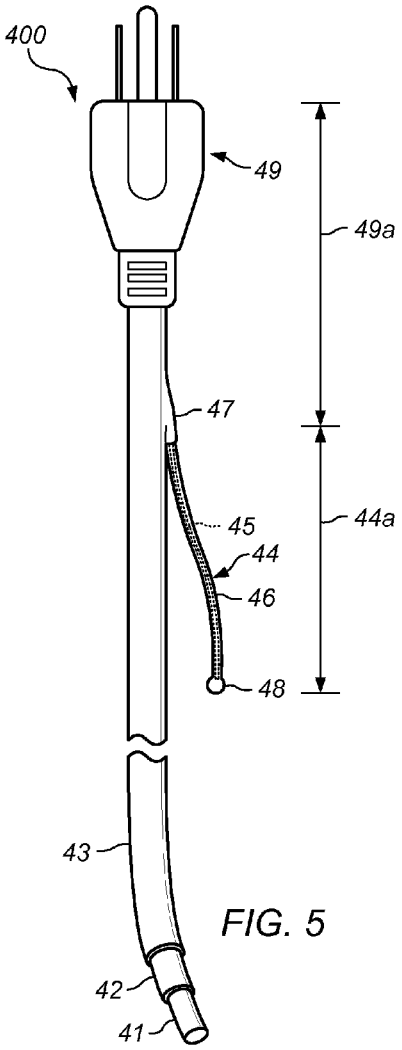
FIG. 5 is a side view of an embodiment of an electric cord including a flexible, bendable securing member.

FIG. 5 illustrates an embodiment of an electric cord. Electric cord 400 includes flexible conductor 41 coupled to power plug 49. Flexible conductor 41 is encased by flexible conduit 42. Flexible conduit 42 is encased by insulating sheath 43. Mounted on the exterior of insulating sheath 43 is securing member 44. In some embodiments, the securing member is of sufficient length to wrap circumferentially around a section of a coiled portion of the electric cord at least once (see FIGS. 8*a*-8*b*). In some embodiments, the securing member is located on the insulating sheath such that the distal end of the member cannot contact the ends of the cord. For example, the length of securing member 44 (see 44*a* of FIG. 5) is less than the distance from the end of the cord to the proximal end of the securing member (see 49*a* of FIG. 5). Positioning the securing member in this manner may advantageously prohibit the distal end of the wire from being twisted or folded back into an electrical socket when the electric cord is plugged in. According to the depicted embodiment, securing member 44 includes pliable wire 45 encased by coating material 46. Pliable wire 46 includes neck 47 and handle 48. In some embodiments, a plurality of securing members are mounted on the exterior of the insulating sheath. The securing members may be mounted at predetermined intervals.

FIGS. 6*a*-8*b* illustrate electric cord securing devices 100, 200, and electric cord 400 respectively in various stages of use.

Figure 6A:
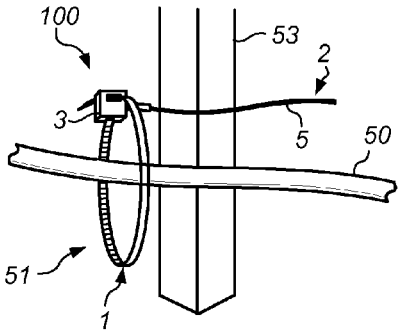
FIGS. 6*a*-6*d* are perspective views of an embodiment of an electric cord securing device progressively securing an electric cord to an external structure.
Figure 6B:
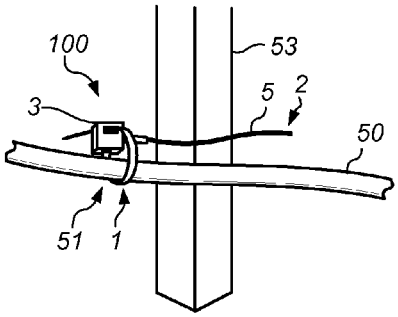
Figure 6D:
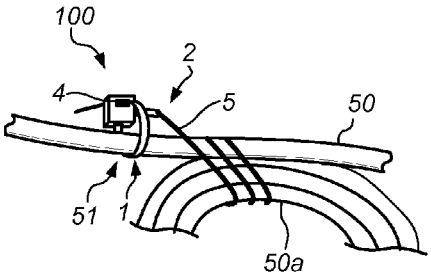
Figure 6C:
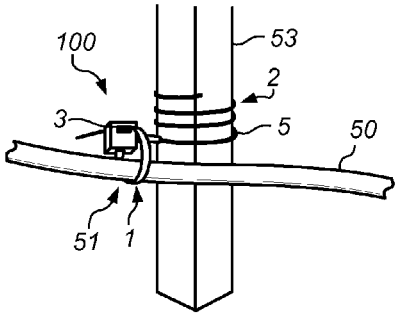

FIGS. 6*a*-6*d* illustrate electric cord securing device 100 in use. In FIG. 6*a*, attaching member 1 is received by housing 3, such that cinching loop 51 is formed. Cinching loop 51 surrounds a selected exterior portion of electric cord 50. In FIG. 6*b*, attaching member 1 has been pulled through housing 3, thereby tightening cinching loop 51 around the selected portion of electric cord 50. As such, body 4 is fixably attached to the selected exterior portion of the coiled electric cord 50. In FIG. 6*c*, pliable wire 5 of securing member 2 has been twisted or wrapped around external structure 53, thus securing the body of the electric cord to the external structure. In some embodiments (e.g., as depicted in FIG. 6*d*), pliable wire 5 is twisted or wrapped around at least at least one other portion of the electric cord 50*a*, thus securing body 4 of device 100 to the other portion of the cord.

Figure 7A:
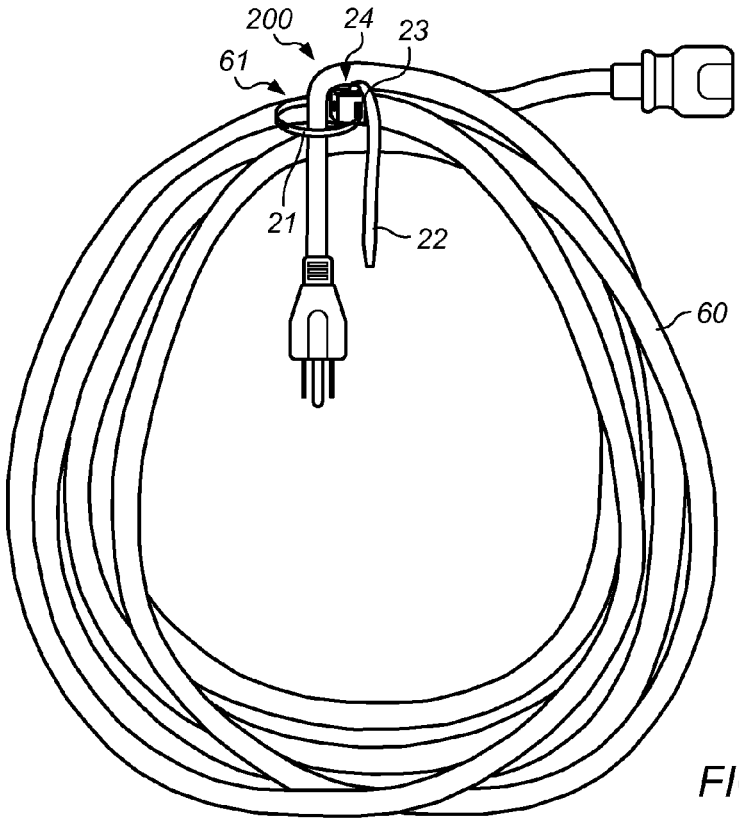
FIGS. 7*a*-7*d* are perspective views of an embodiment of an electric cord securing device progressively securing an electric cord in a coiled bundle.
Figure 7B:
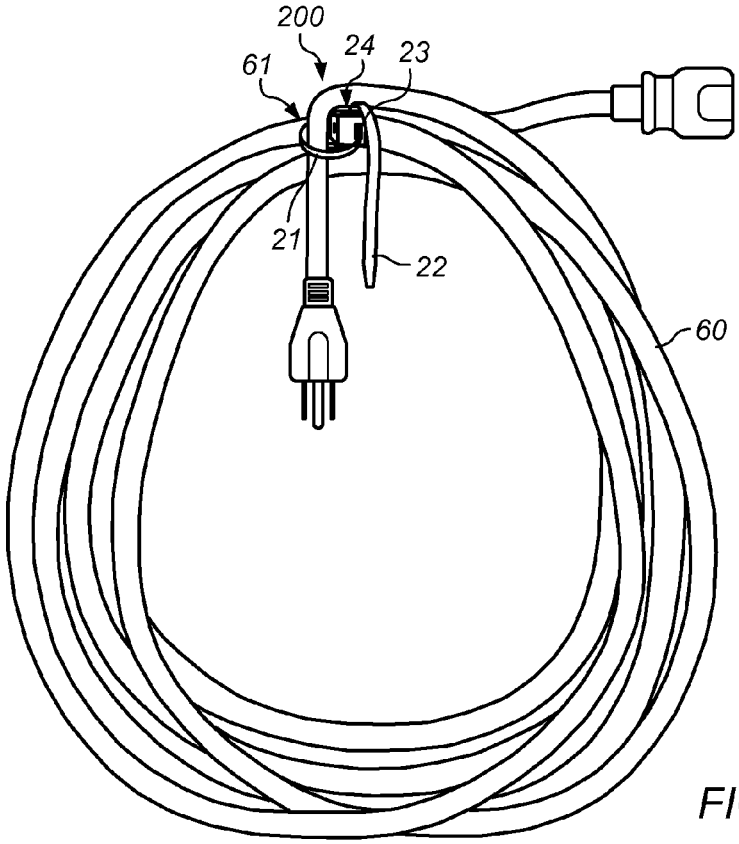
Figure 7C:
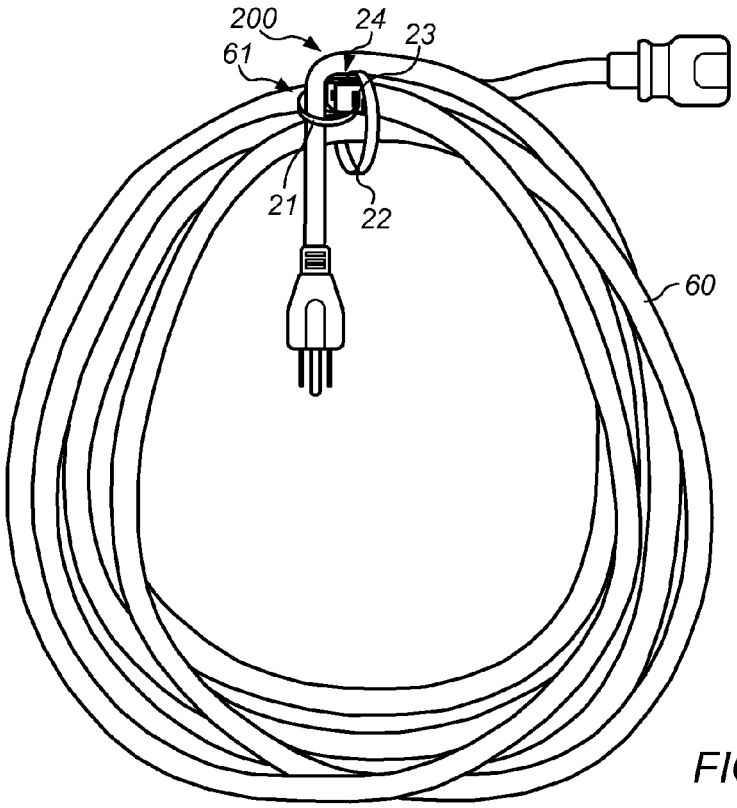
Figure 7D:
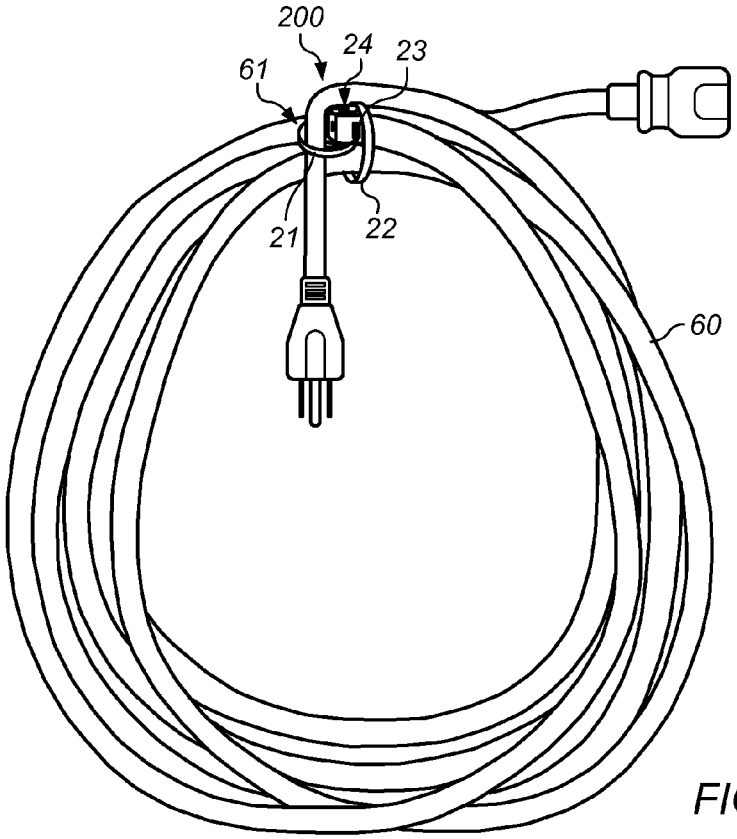

FIGS. 7*a*-7*d* illustrate electric cord securing device 200 in use. In FIG. 7*a*, attaching member 21 is received by housing 23, such that cinching loop 61 is formed. Cinching loop 61 surrounds a selected exterior portion of electric cord 60 near one end of the cord. In FIG. 7*b*, attaching member 21 has been pulled through housing 23, thereby tightening cinching loop 61 around the portion of electric cord 60. As such, body 24 is fixably attached to the selected exterior portion of electric cord 60. In FIG. 7*c*, securing member 22 is received by housing 25 (not shown), such that cinching loop 62 is formed. Cinching loop 62 circumferentially surrounds a section of the coil formed by electrical cord 60. In FIG. 7*d*, securing member 22 has been pulled through a separate housing, thereby tightening cinching loop 61 around the section of the coil formed by electrical cord 60. As such, body 24 is secured to the coiled portion of electric cord 60.

Figure 8A:
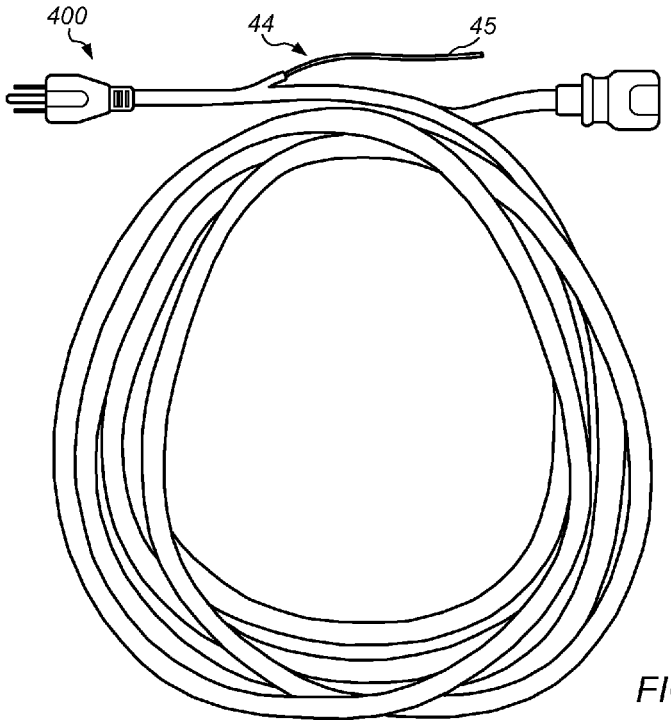
FIGS. 8*a*-8*c* are perspective views of an embodiment of an electric cord being progressively secured in a coiled bundle or to an external structure via a coupled flexible, bendable securing member.
Figure 8B:
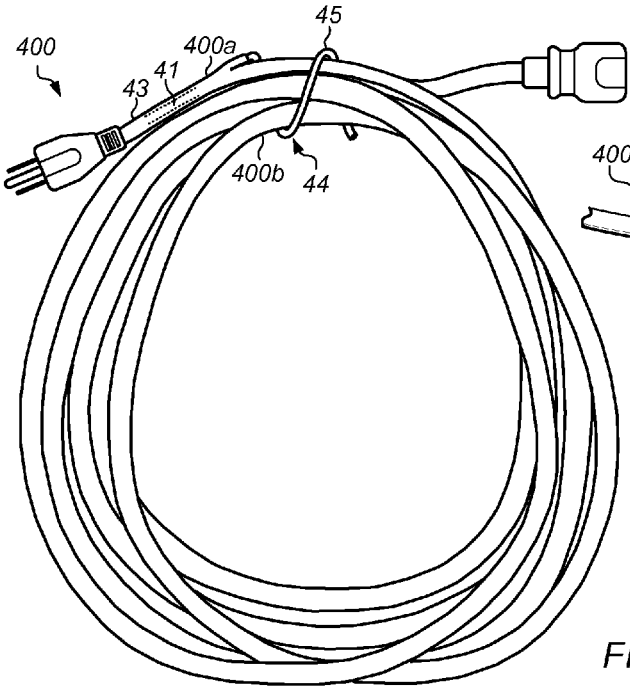
Figure 8C:
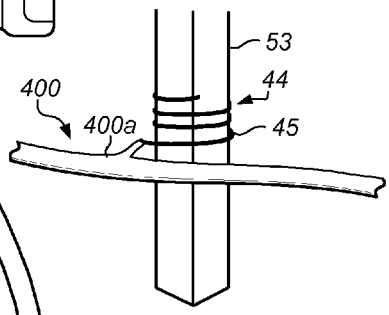

FIGS. 8*a*-8*c* illustrate electric cord 400 in use. In FIG. 8*a*, electric cord 400 (including flexible conductor 41 encased with insulating sheath 43) is coiled with securing member 44 extending from one end. In FIG. 8*b*, pliable wire 45 of securing member 44 has been twisted or wrapped around the coiled section of electric cord 400, thus securing the portion 400*a* of the electric cord proximate securing member 44 to the additional portions 400*b* of the electric cord 400. In some embodiments (e.g., as depicted in FIG. 8*c*), pliable wire 45 is twisted or wrapped around at least a portion of external structure 53, thus securing the portion 400*a* of the electric cord proximate securing member 44 to the external structure.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A device for securing an electric cord comprising:

a body; and an attaching member coupled to the body, wherein the attaching member, during use, directly attaches the body to an electric cord on an exterior of the electrical cord, such that the body is fixably attached to the electric cord; and a securing member comprising a pliable wire and coupled to the body, wherein the securing member, during use, removably secures the body to an external structure or at least one other portion of the electric cord, and wherein the pliable wire comprises suitable mechanical stiffness to be twisted or wrapped around the external structure or to be twisted or wrapped around the at least one other portion of the electric cord.

2. The electric cord securing device of claim 1, wherein the body comprises one or more housings, and wherein at least one of the housings, during use, receives the attaching member, such that when a distal end of the attaching member is fed through the housing a cinching loop is formed.

3. The electric cord securing device of claim 2, wherein the at least one housing, during use, comprises a fastener, wherein the fastener facilitates tightening and loosening of the cinching loop.

4. The electric cord securing device of claim 2, wherein the cinching loop formed with the securing member and the securing member are coupled to the body such that the cinching loop and the securing member are substantially perpendicular to each other.

5. The electric cord securing device of claim 1, wherein a portion of the pliable wire has a higher mechanical stiffness than other portions of the pliable wire.

6. The electric cord securing device of claim 1, wherein the distal end of the pliable wire comprises a handle.

7. The electric cord securing device of claim 1, wherein the distal end of the pliable wire comprises a clamp.

8. The electric cord securing device of claim 1, wherein the pliable wire of the securing member is encased by a polymeric coating.

9. The device of claim 1, wherein the attaching member comprises a pliable wire.

10. The device of claim 9, wherein the pliable wire of the securing member has a mechanical stiffness that is greater than the mechanical stiffness of the pliable wire of the attaching member.

11. The device of claim 1, wherein the length of the securing member is greater than the length of the attaching member.

12. The device of claim 1, wherein the securing member is of a sufficient mechanical stiffness to bind a coiled portion of the electrical cord when wrapped or twisted circumferentially at least once around a section of the coiled portion.

13. The device of claim 1, wherein the electric cord is a coiled electric cord, and wherein the securing member, during use, binds the coiled portion of the electrical cord, such that the body is secured to the coiled portion of the electrical cord.

14. The device of claim 1, wherein the attaching member is removably coupled to the body.

15. An electric cord comprising: at least one flexible conductor; and an insulating sheath encasing at least a portion of the at least one flexible conductor, wherein the insulating sheath comprises: at least one securing member comprising a pliable wire, wherein the pliable wire, during use, secures a portion of the electrical cord proximate the pliable wire to at least one other portion of the electrical cord or an external structure by twisting or wrapping the pliable wire around the at least one other portion of the electric cord or the external structure.

16. A method of securing an electric cord comprising:

coupling an electric cord securing device to an electric cord, the electric cord securing device comprising: a body; and an attaching member coupled to the body; and a securing member comprising a pliable wire and coupled to the body; and directly attaching the body of the electric cord securing device to a portion of the electric cord on an exterior of the electric cord via the attaching member, such that the body is fixably attached to the electric cord; and securing the body to an external structure or at least one other portion of the electric cord with the securing member, and wherein the pliable wire comprises suitable mechanical stiffness to be twisted or wrapped around the external structure or to be twisted or wrapped around the at least one other portion of the electric cord.

17. The method of claim 16, wherein the body comprises one or more housings, and wherein at least one of the housings, during use, receives the attaching member, such that when a distal end of the attaching member is fed through the housing a cinching loop is formed.

18. The method of claim 17, wherein the pliable wire of the securing member has a mechanical stiffness that is greater than the mechanical stiffness of the pliable wire of the attaching member.

19. A method of securing an electric cord comprising:

securing a first portion of the electric cord to at least one other portion of the electric cord or an external structure, the electric cord comprising: at least one flexible conductor; and an insulating sheath encasing at least a portion of the at least one flexible conductor, wherein the insulating sheath comprises at least one securing member comprising a pliable wire and configured to secure a portion of the electric cord proximate the pliable wire to at least one other portion of the electric cord or an external structure by twisting or wrapping the pliable wire around the at least one other portion of the electric cord or the external structure.

20. The method of claim 19, further comprising positioning at least one securing member such that the distal end of the securing member cannot contact either end of the electrical cord.

* * * * *